US006660695B2

(12) United States Patent
Watts et al.

(10) Patent No.: US 6,660,695 B2
(45) Date of Patent: Dec. 9, 2003

(54) POWER TRANSMISSION FLUIDS OF IMPROVED ANTI-SHUDDER PROPERTIES

(75) Inventors: Raymond F. Watts, Long Valley, NJ (US); Katherine M. Richard, Fanwood, NJ (US)

(73) Assignee: Infineum International Ltd. (GB)

( * ) Notice: Subject to any disclaimer, the term of this patent is extended or adjusted under 35 U.S.C. 154(b) by 47 days.

(21) Appl. No.: 10/099,040

(22) Filed: Mar. 15, 2002

(65) Prior Publication Data

US 2003/0181339 A1 Sep. 25, 2003

(51) Int. Cl.[7] ..... C10M 141/12

(52) U.S. Cl. ..... 508/195; 508/196; 508/294; 508/433; 508/438; 508/441; 508/442

(58) Field of Search ..... 508/195, 196, 508/294, 433, 438, 441, 442

(56) References Cited

U.S. PATENT DOCUMENTS 3,751,530 A * 8/1973 Oswald et al. ..... 558/109
5,942,472 A * 8/1999 Watts et al. ..... 508/291
5,972,851 A * 10/1999 Srinivasan et al. ..... 508/188
6,077,455 A * 6/2000 Bloch et al. ..... 252/77
6,225,266 B1 * 5/2001 Watts et al. ..... 508/193
6,337,309 B1 * 1/2002 Watts et al. ..... 508/291

FOREIGN PATENT DOCUMENTS

GB 1569730 * 6/1980

* cited by examiner

*Primary Examiner*—Jaqueline V. Howard

(57) ABSTRACT

A power transmission fluid comprising a mixture of a major amount of a lubricating oil and an effective amount of a performance enhancing additive combination comprising: (a) at least one organic phosphate having the structure $R_1—X_2—P(:X_1)(R_2X_3)—X—R_5$ where $R_1$, and $R_2$ may independently be substituted or unsubstituted alkyl, aryl, alkylaryl or cycloalkyl having 1 to 24 carbon atoms and X, $X_1$, $X_2$ and $X_3$ may independently be sulfur or oxygen. $R_1$ and $R_2$ may also contain substituent hetero atoms, in addition to carbon and hydrogen, such as chlorine, sulfur, oxygen or nitrogen; wherein $R_5$ is derived from a reactive olefin and can be either $CH_2—CHR—C(:O)O—R_6$; $—CH_2—CR_7HR_8$; or $R_9—OC(:O)CH_2—CH—C(:O)O—R_{10}$ where R is H or the same as $R_1$, $R_6$, $R_7$, $R_9$ and $R_{10}$ are the same as $R_1$ and $R_8$ is a phenyl or alkyl or alkenyl substituted phenyl moiety, the moiety having from 6 to 30 carbon atoms, (b) a calcium detergent, and (c) a friction modifier.

22 Claims, No Drawings

POWER TRANSMISSION FLUIDS OF IMPROVED ANTI-SHUDDER PROPERTIES

BACKGROUND OF THE INVENTION

This invention relates to a composition and a method of improving the properties of power transmitting fluids, particularly to obtaining power transmission fluids of improved anti-shudder durability.

Transmissions used in passenger cars and heavy duty vehicles continue to become more sophisticated in design as vehicle technology advances. These design changes result from the need to improve vehicle operability, reliability, and fuel economy. Vehicle manufacturers worldwide are increasing vehicle warrantee periods and service intervals on their vehicles. This means that the transmission and the transmission fluid must be designed to operate reliably without maintenance for longer periods of time. In the case of the fluid, this means longer drain intervals. To improve vehicle operability, especially at low temperature, manufacturers have imposed strict requirements for fluid viscosity at −40° C. To cope with longer drain intervals and more severe operating conditions, manufacturers have increased the requirements for fluid oxidation resistance, required less change in viscosity with vehicle mileage (improved shear stability) and increased the amount of wear protection that the fluid must provide for the transmission. To improve the fuel economy of the vehicle and reduce energy loss, manufacturers employ continuously slipping clutches either as wet starting clutches or as a torque converter clutch. These devices require very precise control of fluid frictional properties.

One method of improving overall vehicle fuel economy used by transmission designers is to build into the torque converter a clutch mechanism capable of "locking" the torque converter. "Locking" refers to eliminating relative motion between the driving and driven members of the torque converter so that no energy is lost in the fluid coupling. These "locking" or "lock-up" clutches are very effective at capturing lost energy at high road speeds; however, when they are used at low speeds vehicle operation is rough and engine vibration is transmitted through the drive train. Rough operation and engine vibration are not acceptable to drivers.

The higher the percentage of time that the vehicle can be operated with the torque converter clutch engaged, the more fuel efficient the vehicle becomes. A second generation of torque converter clutches have been developed which operate in a "slipping" or "continuously sliding mode". These devices have a number of names, but are commonly referred to as continuously slipping torque converter clutches. The difference between these devices and lock-up clutches is that they allow some relative motion between the driving and driven members of the torque converter, normally at relative speeds of 10 to 100 rpm. This slow rate of slipping allows for improved vehicle performance as the slipping clutch acts as a vibration damper. Whereas the "lock-up" type clutch could only be used at road speeds above approximately 50 mph, the "slipping" type clutches can be used at speeds as low as 25 mph, thereby capturing significantly more lost energy. It is this feature that makes these devices very attractive to vehicle manufacturers.

A second method of reducing energy loss in the engine—transmission coupling is to use a wet starting clutch. These wet starting clutches resemble shifting clutches but are made to handle the entire energy of the vehicle. Therefore they tend to be physically larger than shifting clutches. However, just as with the torque converter clutch they are continuously slipped to improve overall vehicle driveability and ride feel.

It is well known that improving friction durability of power transmission fluids can be accomplished by the selection of the appropriate types of friction modifiers. However, we have found that the combination of friction modifier and anti-wear agent is the most critical factor in improving friction durability. Selection of the correct anti-wear agent is as important as the selection of the correct friction modifier system.

Due to the efficacy of continuously slipping clutches they are fitted to all types of transmissions. Continuously slipping torque converter clutches and wet starting clutches are routinely used with conventional automatic transmissions, continuously variable transmissions (CVTs), and manual transmissions. Continuously slipping clutches impose very exacting friction requirements on power transmission fluids used with them. The fluid must have a very good friction versus velocity relationship, i.e., friction must always increase with increasing speed. If friction decreases with increasing speed, a self-exciting vibrational state can be set up in the driveline. This phenomenon is commonly called "stick-slip" or "dynamic frictional vibration" and manifests itself as "shudder" or low speed vibration in the vehicle. Clutch shudder is very objectionable to the driver. A fluid which allows the vehicle to operate without vibration or shudder is said to have good "anti-shudder" characteristics. Not only must the fluid have an excellent friction versus velocity relationship when it is new, but the fluid must retain those frictional characteristics over the lifetime of the fluid, which can be the lifetime of the transmission. The longevity of the anti-shudder performance in the vehicle is commonly referred to as "anti-shudder durability". It is this aspect of fluid frictional performance that this invention addresses.

Control of fluid viscosity is also critical to transmissions with hydraulic operating systems, such as conventional automatic transmissions, continuously variable transmissions and automated manual transmissions. Changes in fluid viscosity caused by shearing or oxidation of polymeric thickeners is detrimental to good transmission operation. Therefore when polymeric viscosity modifiers are used, they should be shear stable materials.

We have now found that a combination of anti-wear agents and calcium detergents when used with known friction modifiers produce fluids of significantly improved anti-shudder durability. These fluids are particularly suited for use as CVT fluids since they do not adversely effect the steel-on-steel coefficient of friction developed by the fluid in CVT variators.

SUMMARY OF THE INVENTION

The present invention is a power transmission fluid comprising:

(1) a major amount of a lubricating oil; and (2) an effective amount of a performance enhancing anti-shudder additive combination comprising:

(a) an organic phosphate having the structure: $R_1$—$X_2$—P(:$X_1$)($R_2X_3$)—X—$R_5$ where $R_1$, and $R_2$ may independently be substituted or unsubstituted alkyl, aryl, alkylaryl or cycloalkyl having 1 to 24 carbon atoms and X, $X_1$, $X_2$ and $X_3$ may independently be sulfur or oxygen. $R_1$, and $R_2$ may also contain substituent hetero atoms, in addition to carbon and hydrogen, such as chlorine, sulfur, oxygen or nitrogen; wherein $R_5$ is derived from a reactive olefin and can be either −$CH_2$—CHR—C (:O)O—$R_6$; —$CH_2$—$CR_7HR_8$; or $R_9$—OC(:O)$CH_2$—CH—C(:O)O—$R_{10}$ where R is H or the same as $R_1$ $R_6$, $R_7$, $R_9$ and $R_{10}$ are the same as $R_1$ and $R_8$ is a phenyl or alkyl or alkenyl substituted phenyl moiety, the moiety having from 6 to 30 carbon atoms;

(b) a calcium detergent; and (c) a friction modifier.

Further embodiments of this invention are a continuously variable transmission or an automatic transmission apparatus containing the fluids of this invention, a method for lubricating such apparatus using the fluids of this invention and the novel additive combination of (a), (b) and (c) above.

DETAILED DESCRIPTION OF THE INVENTION

Lubricating a continuously variable transmission equipped with a steel push belt or chain drive variator and a slipping clutch system is not a simple matter. It presents a unique problem of providing high steel-on-steel friction for the variator and excellent paper-on-steel friction for the slipping clutch. Added to these requirements is the need for the fluid to provide a positive $d\mu/dV$ over a wide range of operating temperatures. Therefore, the friction modifier system must be selected so as to provide very precise control of the steel-on-steel friction and the paper-on-steel friction over a wide range of temperatures.

Lubricating oils useful in this invention are derived from natural lubricating oils, synthetic lubricating oils, and mixtures thereof. In general, both the natural and synthetic lubricating oil will each have a Kinematic viscosity ranging from about 1 to about 100 $mm^2/s$ (cSt) at 100° C., although typical applications will require the lubricating oil or lubricating oil mixture to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlorodiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have Kinematic viscosities of from 2.0 $mm^2/S$ (cSt) to 8.0 $mm^2/s$ (cSt) at 100° C. The preferred mineral oils have Kinematic viscosities of from 2 to 6 $mm^2/s$ (cSt), and most preferred are those mineral oils with viscosities of 3 to 5 $mm^2/S$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly (1-octenes), poly-(1-decenes), etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000 to 1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetrahydrofurans, poly-α-olefins, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

The additive system of this invention comprises an organic phosphate have the structure: $R_1$—$X_2$—P(:$X_1$)($R_2X_3$)—X—$R_5$ where $R_1$, and R2 may independently be substituted or unsubstituted alkyl, aryl, alkylaryl or cycloalkyl having 1 to 24 carbon atoms and X, $X_1$, $X_2$ and $X_3$ may independently be sulfur or oxygen. $R_1$ and $R_2$ may also contain substituent hetero atoms, in addition to carbon and hydrogen, such as chlorine, sulfur, oxygen or nitrogen; wherein $R_5$ is derived from a reactive olefin and can be either —$CH_2$—CHR—C(:O)O—$R_6$; —$CH_{2-CR7}HR_8$; or $R_9$—OC(:O)$CH_2$—CH—C(:O)O—$R_{10}$ where R is H or the same as $R_1$, $R_6$, $R_7$, $R_9$ and $R_{10}$ are the same as $R_1$ and $R_8$ is a phenyl or alkyl or alkenyl substituted phenyl moiety, the moiety having from 6 to 30 carbon atoms.

This invention is based on the discovery that the use of the foregoing phosphate in combination with a neutral or over-based calcium detergent additive and a friction modifier provides a fluid exhibiting excellent anti-shudder durability as well as steel-on-steel friction characteristics.

It is well known that phosphates produced by the reaction of alcohols or thiols with phosphorus anhydrides such as $P_2O_5$, $P_2S_5$, $P_4S_{10}$ are excellent anti-wear agents. However their use is limited by their very high acidity. Two methods are known for reducing the acidity of these materials thereby increasing their usefulness. The first method is to neutralize the acidic —OH or —SH group using an amine. Common primary and secondary amines are used for this purpose. See for example U.S. Pat. No. 3,197,405. This method suffers from the fact that the salts produced can dissociate in service and the corrosive aspects of the phophate's performance can return. A second method is to react the acidic —SH or —OH group with an activated double bond containing material. One type of activated double bond containing materials are esters. Examples of suitable esters are acrylate esters like ethyl acrylate or ethyl methacrylate; maleic or fumaric acid esters such as di-butyl maleate or isopropyl fumarate. A second type of activated double bond containing material are activated ethylinic materials, also known as vinyls, such as styrene or alpha methyl styrene. Examples of such materials are Irgalube 63 from Ciba-Geigy, of the formula $(R—O)_2$—P(:S)—S—$CH_2$ $CH_2$ ($COOR_1$) wherein R is $C_3H_7$ (derived from isopropanol) and $R_1$ is $C_2$ to $C_5$; Vanlube 7611M from R. T. Vanderbilt Corporation of the formula $(R—O)_2$—P(:S)—S—CH($COOR_1$) $CH_2COOR_2$ wherein R, $R_1$ and $R_2$ are independently varied from $C_3$ to $C_8$; and Infineum T9450, of the formula $(R—O)_2$—P(:S)—S—$CH_2$ $CH_2$—$R_3$ wherein R is $C_9$ alkyl phenyl (derived from nonyl phenol) and $R_3$ is phenyl.

Any effective amount of the phosphate material can be used. However the concentration of the phosphate in the finished lubricant would normally be from 0.01 to 10 percent by mass. The preferred amount would be from 0.05 to 5.0 percent and the most preferred amounts would be from 0.1 to 1 percent.

The calcium-containing detergents which comprise the second additive component of the compositions of this invention may be oil-soluble neutral or overbased calcium salts of one or more of the following acidic substances (or mixtures thereof): (1) sulfonic acids, (2) carboxylic acids, (3) salicylic acids, (4) alkyl phenols and (5) sulfurized alkyl phenols.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like.

The term "overbased" in connection with metallic detergents is used to designate metal salts wherein the metal is present in stoichiometrically larger amounts than the organic radical. The commonly employed methods for preparing the over-based salts involve heating a mineral oil solution of an acid with a stoichiometric excess of a metal neutralizing agent such as the metal oxide, hydroxide, carbonate, bicarbonate, of sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60 to 200° C. Overbased detergents have a TBN (total base number, ASTM D-2896) typically of 150 or more such as 250–450.

Examples of suitable metal-containing detergents include, but are not limited to, neutral and overbased salts of such substances as calcium phenates, sulfurized calcium phenates, wherein each aromatic group has one or more aliphatic groups to impart hydrocarbon solubility; calcium sulfonates, wherein each sulfonic acid moiety is attached to an aromatic nucleus which in turn usually contains one or more aliphatic substituents to impart hydrocarbon solubility; calcium salicylates wherein the aromatic moiety is usually substituted by one or more aliphatic substituents to impart hydrocarbon solubility, salts of hydrolyzed phosphosulfurized olefins having 10 to 2,000 carbon atoms or of hydrolyzed phosphosulfurized alcohols and/or aliphatic-substituted phenolic compounds having 10 to 2,000 carbon atoms; calcium salts of aliphatic carboxylic acids and aliphatic substituted cycloaliphatic carboxylic acids; and many other salts of oil-soluble organic acids. Mixtures of neutral or over-based salts of two or more different alkali and/or alkaline earth metals can be used. Likewise, neutral and/or overbased salts of mixtures of two or more different acids (e.g. one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Methods for the production of oil-soluble neutral and overbased metallic detergents and alkaline earth metal-containing detergents are well known to those skilled in the art, and extensively reported in the patent literature. See for example, the disclosures of U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; 4,880,550.

The metallic detergents utilized in this invention can, if desired, be oil-soluble boronated neutral and/or overbased alkali of alkaline earth metal-containing detergents. Methods for preparing boronated metallic detergents are described in, for example, U.S. Pat. Nos. 3,480,548; 3,679,584; 3,829,381; 3,909,691; 4,965,003; 4,965,004.

Preferred calcium detergents for use with this invention are overbased calcium sulfonates and phenates and overbased sulfurized calcium phenates.

While any effective amount of the calcium overbased detergent may be used to achieve the benefits of this invention, typically effective amounts will be from 0.01 to 5.0 mass percent in the finished fluid. Preferably the treat rate in the fluid will be from 0.05 to 3.0 mass percent, and most preferred is 0.1 to 1.0 mass percent.

The composition of this invention will also contain one or more friction modifiers, which are typically present in the range of 0.01 to 10 wt. %, preferably about 0.1 to 5.0 wt. %.

Friction modifiers preferably present in the fluid compositions of the current invention are succinimide compounds having the structure II:

Structure II

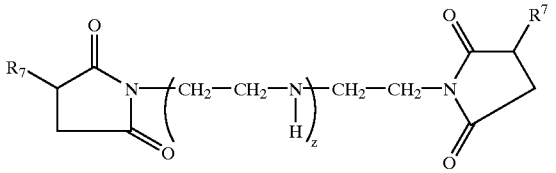

wherein $R_7$ is $C_6$ to $C_{30}$ alkyl, and z=1 to 10.

The alkenyl succinic anhydride starting materials for forming the friction modifiers of structure II can be either of two types. The two types differ in the linkage of the alkyl side chain to the succinic acid moiety. In the first type, the alkyl group is joined through a primary carbon atom in the starting olefin, and therefore the carbon atom adjacent to the succinic acid moiety is a secondary carbon atom. In the second type, the linkage is made through a secondary carbon atom in the starting olefin and these materials accordingly have a branched or isomerized side chain. The carbon atom adjacent to the succinic acid moiety therefore is necessarily a tertiary carbon atom.

The alkenyl succinic anhydrides of the first type, shown as structure III, with linkages through secondary carbon atoms, are prepared simply by heating α-olefins, that is, terminally unsaturated olefins, with maleic anhydride. Examples of these materials would include n-decenyl succinic anhydride, tetradecenyl succinic anhydride, n-octadecenyl succinic anhydride, tetrapropenyl succinic anhydride, etc.

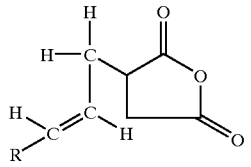

wherein R is $C_3$ to $C_{27}$ alkyl.

The second type of alkenyl succinic anhydrides, with linkage through tertiary carbon atoms, are produced from internally unsaturated olefins and maleic anhydride. Internal olefins are olefins which are not terminally unsaturated, and therefore do not contain the

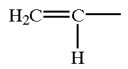

moiety. These internal olefins can be introduced into the reaction mixture as such, or they can be produced in situ by exposing α-olefins to isomerization catalysts at high temperatures. A process for producing such materials is described in U.S. Pat. No. 3,382,172. The isomerized alkenyl substituted succinic anhydrides are compounds having structure IV:

Structure IV

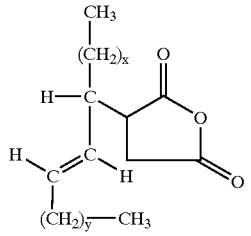

where x and y are independent integers whose sum is from 1 to 30.

The preferred succinic anhydrides are produced from isomerization of linear α-olefins with an acidic catalyst followed by reaction with maleic anhydride. The preferred α-olefins are 1-octene, 1-decene, 1-dodecene, 1-tetradecene, 1-hexadecene, 1-octadecene, 1-eicosane, or mixtures of these materials. The products described can also be produced from internal olefins of the same carbon numbers, 8 to 20. The preferred materials for this invention are those made from 1-tetradecene (x+y=9), 1-hexadecene (x+y=11) and 1-octadecene (x+y=13), or mixtures thereof.

The alkenyl succinic anhydrides are then further reacted with polyamines having the following structure V:

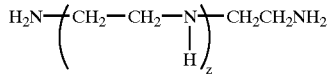

where z is an integer from 1 to 10, preferably from 1 to 3.

The preferred succinimide friction modifiers of this invention are products produced by reacting the isomerized alkenyl succinic anhydride with diethylene triamine, triethylene tetramine, tetraethylene pentamine or mixtures thereof. The most preferred products are prepared using tetraethylene pentamine. The alkenyl succinic anhydrides are typically reacted with the amines in a 2:1 molar ratio so that both primary amines are converted to succinimides. Sometimes a slight excess of isomerized alkenyl succinic anhydride is used to insure that all primary amines have reacted. The products of the reaction are compound of structure II.

The two types of succinimide friction modifiers can be used individually or in combination.

The disuccinimides of structure II may be post-treated or further processed by any number of techniques known in the art. These techniques would include, but are not limited to, boration, maleation, and acid treating with inorganic acids such as phosphoric acid, phosphorous acid, and sulfuric acid. Descriptions of these processes can be found in, for example, U.S. Pat. No. 3,254,025; U.S. Pat. No. 3,502,677; U.S. Pat. No. 4,686,054; and U.S. Pat. No. 4,857,214.

Another useful derivative of the succinimide modifiers are where the alkenyl groups of structures II, III and IV have been hydrogenated to form their saturated alkyl analogs. Saturation of the condensation products of olefins and maleic anhydride may be accomplished before or after reaction with the amine. These saturated versions of structures II, III and IV may likewise be post-treated as previously described.

While any effective amount of the compounds of structure II and its derivatives may be used to achieve the benefits of this invention, typically these effective amounts will range from 0.01 to 10 wt. % of the finished fluid, preferably from 0.05 to 7 wt. %, most preferably from 0.1 to 5 wt. %.

Ethoxylated amine friction modifiers are also useful in the CVT fluids of the current invention and these are compounds having structure VI:

Structure VI

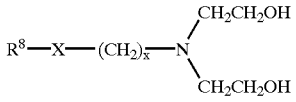

wherein $R_8$ is a $C_6$ to $C_{28}$ alkyl group, X is O, S or $CH_2$, and x=1 to 6.

Alkoxylated amines are a particularly suitable type of friction modifier for use in this invention. Preferred amine compounds contain a combined total of from about 18 to about 30 carbon atoms. In a particularly preferred embodiment, this type of friction modifier is characterized by structure VI where X represents oxygen, $R_8$ contains a total of 18 carbon atoms, and x=3.

Preparation of the amrine compounds, when X is oxygen and x is 1, is, for example, by a multi-step process where an alkanol is first reacted, in the presence of a catalyst, with an unsaturated nitrile such as acrylonitrile to form an ether nitrile intermediate. The intermediate is then hydrogenated, preferably in the presence of a conventional hydrogenation catalyst, such as platinum black or Raney nickel, to form an ether amine. The ether amine is then reacted with an alkylene oxide, such as ethylene oxide, in the presence of an alkaline catalyst by a conventional method at a temperature in the range of about 90–150° C.

Another method of preparing the amine compounds, when X is oxygen and x is 1, is to react a fatty acid with ammonia or an alkanol amine, such as ethanolamine, to form an intermediate which can be further oxyalkylated by reaction with an alkylene oxide, such as ethylene oxide or propylene oxide. A process of this type is discussed in, for example, U.S. Pat. No. 4,201,684.

When X is sulfur and x is 1, the amine friction modifying compounds can be formed, for example, by effecting a conventional free radical reaction between a long chain α-olefin with a hydroxyalkyl mercaptan, such as α-hydroxyethyl mercaptan, to produce a long chain alkyl hydroxyalkyl sulfide. The long chain alkyl hydroxyalkyl sulfide is then mixed with thionyl chloride at a low temperature and then heated to about 40° C. to form a long chain alkyl chloroalkyl sulfide. The long chain alkyl chloroalkyl sulfide is then caused to react with a dialkanolamine, such as diethanolamine, and, if desired, with an alkylene oxide, such as ethylene oxide, in the presence of an alkaline catalyst and at a temperature near 100° C. to form the desired amine compounds. Processes of this type are known in the art and are discussed in, for example, U.S. Pat. No. 3,705,139.

In cases when X is oxygen and x is 1, the present amine friction modifiers are well known in the art and are described in, for example, U.S. Pat. Nos. 3,186,946, 4,170,560, 4,231,883, 4,409,000 and 3,711,406.

Examples of suitable amine compounds include, but are not limited to, the following: N,N-bis(2-hydroxyethyl)-n-dodecylamine; N,N-bis(2-hydroxyethyl)-1-methyl-tridecenylamine; N,N-bis(2-hydroxyethyl)-hexadecylamine; N,N-bis(2-hydroxyethyl)-octadecylamine; N,N-bis(2-hydroxyethyl)-octadecenyl-amine; N,N-bis(2-hydroxyethyl)-oleylamine; N-(2-hydroxyethyl)-N-(hydroxy-ethoxyethyl)-n-dodecylamine; N,N-bis(2-hydroxyethyl)-n-dodecyloxyethylamine; N,N-bis(2-hydroxyethyl)-dodecylthioethylamine; N,N-bis(2-hydroxyethyl)-dodecyl-thiopropylamine; N,N-bis(2-hydroxyethyl)-hexadecyloxypropylamine; N,N-bis(2-hydroxyethyl)-hexadecylthiopropylamine; N-2-hydroxyethyl,N-[N',N'-bis(2-hydroxyethyl) ethylamine]-octadecylamine; and N-2-hydroxyethyl,N-[N',N'-bis(2-hydroxy-ethyl)ethylamine]-stearylamine.

The most preferred additive is N,N-bis(2-hydroxyethyl)-hexadecyloxypropylamine which is sold by the Tomah Chemical Co. under the designation E-22-S-2.

The amine compounds may be used as such, however, they may also be used in the form of an adduct or reaction product with a boron compound, such as a boric oxide, a boron halide, a metaborate, boric acid, or a mono-, di-, and trialkyl borate. Such adducts or derivatives may be illustrated, for example, by the following structural formula:

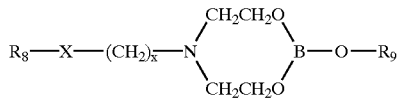

where $R_8$, X, and x are the same as previously defined for structure VI and where $R_9$ is either hydrogen or an alkyl radical.

These ethoxylated amine friction modifiers may be present in amounts of 0.01 to 1.0 wt. %, preferably 0.05 to 0.75 wt. %, most preferably 0.1 to 0.5 wt. % of the composition.

Other useful friction modifiers for the fluids of this invention are primary amides of long chain carboxylic acids represented by the structure below:

$RCONH_2$ wherein R is preferably an alkenyl or alkyl group having about 12 to 24 carbons, R is most preferably a $C_{17}$ alkenyl group. The preferred primary amide is oleamide. Oleamide is preferably present in an amount between about 0.001 to 0.50 wt. %, based upon the weight percent of the fully formulated oil composition, most preferably present in an amount of 0.1 wt. %.

Other additives known in the art may be added to the power transmitting fluids of this invention. These additives include ashless dispersants, antiwear agents such as organic phosphates, corrosion inhibitors, metal detergents, extreme pressure additives, viscosity modifiers, seal swellants, pour depressants, antifoam agents, and the like. Such additives are disclosed in, for example, "Lubricant Additives" by C. V. Smalheer and R. Kennedy Smith, 1967, pp. 1–11 and U.S. Pat. No. 4,105,571.

Suitable ashless dispersants for use in this invention include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also useful are condensation products of polyamines and hydrocarbyl substituted phenyl acids. Mixtures of these dispersants can also be used.

Basic nitrogen containing ashless dispersants are well known lubricating oil additives, and methods for their preparation are extensively described in the patent literature. For example, hydrocarbyl-substituted succinimides and succinamides and methods for their preparation are described, for example, in U.S. Pat. Nos.: 3,018,247; 3,018,250; 3,018,291; 3,361,673 and 4,234,435. Mixed ester-amides of hydrocarbyl-substituted succinic acids are described, for example, in U.S. Pat. Nos.: 3,576,743; 4,234,435 and 4,873,009. Mannich dispersants, which are condensation products of hydrocarbyl-substituted phenols, formaldehyde and polyamines are described, for example, in U.S. Pat. Nos.: 3,368,972; 3,413,347; 3,539,633; 3,697,574; 3,725,277; 3,725,480; 3,726,882; 3,798,247; 3,803,039; 3,985,802; 4,231,759 and 4,142,980. Amine dispersants and methods for their production from high molecular weight aliphatic or alicyclic halides and amines are described, for example, in U.S. Pat. Nos.: 3,275,554; 3,438,757; 3,454,55 and 3,565,804.

The preferred dispersants are the alkenyl succinimides and succinamides. The succinimide or succinamide dispersants can be formed from amines containing basic nitrogen and additionally one or more hydroxy groups. Usually, the amines are polyamines such as polyalkylene polyamines, hydroxy-substituted polyamines and polyoxyalkylene polyamines. Examples of polyalkylene polyamines include diethylene triarnine, triethylene tetramine, tetraethylene pentamine, pentaethylene hexamine. Low cost poly (ethyleneamines) (PAM's) averaging about 5 to 7 nitrogen atoms per molecule are available commercially under trade names such as "Polyamine H", "Polyamine 400", Dow Polyamine E-100", etc. Hydroxy-substituted amines include N-hydroxyalkyl-alkylene polyamines such as N-(2-hydroxyethyl)ethylene diamine, N-(2-hydroxyethyl) piperazine, and N-hydroxyalkylated alkylene diamines of the type described in U.S. Pat. No. 4,873,009. Polyoxyalkylene polyamines typically include polyoxyethylene and polyoxypropylene diamines and triamines having average molecular weights in the range of 200 to 2500. Products of this type are available under the Jeffamine trademark.

The amine is readily reacted with the selected hydrocarbyl-substituted dicarboxylic acid material, e.g., alkylene succinic anhydride, by heating an oil solution containing 5 to 95 wt. % of said hydrocarbyl-substituted dicarboxylic acid material at about 100° to 250° C., preferably 125° to 175° C., generally for 1 to 10, e.g., 2 to 6 hours until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from 0.1 to 1.0, preferably from about 0.2 to 0.6, e.g., 0.4 to 0.6, equivalents of dicarboxylic acid unit content (e.g., substituted succinic anhydride content) is used per reactive equivalent of nucleophilic reactant, e.g., amine. For example, about 0.8 mole of a pentamine (having two primary amino groups and five reactive equivalents of nitrogen per molecule) is preferably used to convert into a mixture of amides and imides, a composition derived from reaction of polyolefin and maleic anhydride having a functionality of 1.6; i.e., preferably the pentamine is used in an amount sufficient to provide about 0.4 equivalents (that is, 1.6 divided by (0.8×5) equivalents) of succinic anhydride units per reactive nitrogen equivalent of the amine.

Use of alkenyl succinimides which have been treated with a boronating agent are also suitable for use in the compositions of this invention as they are much more compatible with elastomeric seals made from such substances as fluoroelastomers and silicon-containing elastomers. Dispersants may be post-treated with many reagents known to those skilled in the art. (See, e.g., U.S. Pat. Nos. 3,254,025, 3,502,677 and 4,857,214).

The preferred ashless dispersants are polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 700 to 1200 (preferably 900 to 1100). It has been found that selecting certain dispersants within the broad range of alkenyl succinimides produces fluids with improved frictional characteristics. The most preferred dispersants of this invention are those wherein the polyisobutene substituent group has a molecular weight of approximately 950 atomic mass units, the basic nitrogen containing moiety is polyamine (PAM) and the dispersant has been post treated with a boronating agent.

The ashless dispersants of the invention can be used in any effective amount. However, they are typically used from about 0.1 to 10.0 mass percent in the finished lubricant, preferably from about 0.5 to 7.0 percent and most preferably from about 2.0 to about 5.0 percent.

Another preferred component of the additive system of the current invention is an oil soluble organic phosphite antiwear additive. The organic phosphites useful in this invention are the mono-, and di-hydrocarbyl phosphites having the general structure I, where structure I is represented by:

Structure I

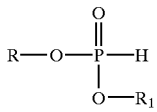

where R is hydrocarbyl and $R_1$ is hydrocarbyl or hydrogen; preferably R or $R_1$ contains a thioether ($CH_2$—S—$CH_2$) group. As used herein, the term "hydrocarbyl" denotes a group having a carbon atom directly attached to the remainder of the molecule and having predominantly hydrocarbon character within the context of this invention. Such groups include the following: (1) hydrocarbon groups; that is, aliphatic, alicyclic (e.g., cycloalkyl or cycloalkenyl), aromatic groups, alkaryl groups, and the like, as well as cyclic groups wherein the ring is completed through another portion of the molecule; (2) substituted hydrocarbon groups;

that is, groups containing non-hydrocarbon substituents which in the context of this invention, do not alter the predominantly hydrocarbon nature of the group. Those skilled in the art will be aware of suitable substituents. Examples include, halo, hydroxy, nitro, cyano, alkoxy, acyl, etc.; (3) hetero groups; that is, groups which while predominantly hydrocarbon in character within the context of this invention, contain atoms of other than carbon in a chain or ring otherwise composed of carbon atoms. Suitable hetero atoms will be apparent to those skilled in the art and include, for example, nitrogen, oxygen and sulfur.

In structure I, when R or $R_1$ is an alkyl, the alkyl groups are $C_4$ to $C_{20}$, preferably $C_6$ to $C_{18}$, most preferably $C_8$ to $C_{16}$. Such groups are known to those skilled in the art. Examples include methyl, ethyl, octyl, decyl, octadecyl, cyclohexyl and phenyl, etc. R or $R_1$ can also vary independently. As stated, R and $R_1$ can be alkyl, or aralkyl, may be linear or branched, and the aryl groups may be phenyl or substituted phenyl. The R and $R_1$ groups may be saturated or unsaturated, and they may contain hetero atoms such as S, N or O. The preferred materials are the dialkyl phosphites (structure I). The R and $R_1$ groups are preferably linear alkyl groups from $C_4$ to $C_{18}$ containing one sulfur atom. The most preferred are decyl, undecyl, 3-thiaundecyl, pentadecyl and 3-thiapentadecyl.

Phosphites of structure I may be used individually or in mixtures.

The preferred embodiment of this invention is the use of the mixed alkyl phosphites described in U.S. Pat. Nos. 5,185,090 and 5,242,612.

While any effective amount of the organic phosphite may be used to achieve the benefits of the invention, typically these effective amounts will be from 0.01 to 5.0 mass percent in the finished fluid. Preferably the treat rate in the fluid will be from 0.2% to 3.0% and most preferred is 0.3% to 1.0%.

Another preferred component of the additive system of the current invention is a shear stable viscosity modifier Viscosity modifiers are oil soluble polymers used to thicken lubricants at high temperatures while causing minimal thickening at low temperatures. Suitable viscosity modifiers include hydrocarbyl polymers and polyesters. Examples of suitable hydrocarbyl polymers include homopolymers and copolymers of two or more monomers of $C_2$ to $C_{30}$, e.g., $C_2$ to C8 olefins, including both α-olefins and internal olefins, which may be straight or branched, aliphatic, aromatic, alkyl-aromatic, cycloaliphatic, etc. Frequently the viscosity modifiers will be copolymers of ethylene with $C_3$ to $C_{30}$ olefins, particularly preferred being the copolymers of ethylene and propylene. Other polymers can be used, such as polyisobutylenes, homopolymers and copolymers of $C_6$ and higher α-olefins, polypropylene, hydrogenated polymers and copolymers and terpolymers of styrene, e.g., with isoprene and/or butadiene.

The preferred viscosity modifiers are polyesters, most preferably polyesters of ethylenically unsaturated $C_3$ to $C_8$ mono- and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl methacrylate, cetyl methacrylate, stearyl methacrylate, and the like and mixtures thereof.

Other esters include the vinyl alcohol esters of $C_2$ to $C_{22}$ fatty or monocarboxylic acids, preferably saturated, such as vinyl acetate, vinyl laurate, vinyl palmitate, vinyl stearate, vinyl oleate, and the like and mixtures thereof. Copolymers of vinyl alcohol esters with unsaturated acid esters such as copolymers of vinyl acetate with dialkyl fumarates, can also be used.

The esters may be copolymerized with still other unsaturated monomers such as olefins, e.g., 0.2 to 5 mol of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, see, e.g. U.S. Pat. No. 3,702,300.

Such ester polymers may be grafted with, or the ester copolymerized with, polymerizable unsaturated nitrogen-containing monomers to impart dispersancy to the viscosity modifiers. Examples of suitable unsaturated nitrogen-containing monomers to impart dispersancy include those containing 4 to 20 carbon atoms such as amino substituted olefins as p-(β-diethylaminoethyl)styrene; basic nitrogen-containing heterocycles carrying a polymerizable ethylenically unsaturated substituent, e.g., vinyl pyridines and vinyl alkyl pyridines such as 2-vinyl-5-ethylpyridine, 2-methyl-5-vinylpyridine, 2-vinylpyridine, 3-vinylpyridine, 4-vinylpyridine, 3-methyl-5-vinylpyridine, 4-methyl-2-vinylpyridine, 4-ethyl-2-vinylpyridine, 2-butyl-5-vinylpyridine, and the like. N-vinyl lactams are also suitable, e.g., N-vinyl pyrrolidones or N-vinyl piperidones.

The vinyl pyrrolidones are preferred and are exemplified by N-vinylpyrrolidone, N-(1 -methylvinyl)pyrrolidone, N-vinyl-5-methylpyrrolidone, N-vinyl-3,3-dimethylpyrrolidone, N-vinyl-5-ethylpyrrolidone, etc.

A second method for adding dispersancy to the polyester polymers is through the carboxylic acid moiety on the backbone. This can be achieved by forming esters or amides with certain nitrogen containing alcohols and amines. Examples of chemicals useful for forming such dispersive polymers are 3-(N,N-dimethylamino)propylamine, 3-(N,N-dimethylamino)propanol, N-(3-aminopropyl)morpholine, N-(3-hydroxypropyl)morpholine, triethylenetetramine, and tetraethylenepentamine. The ester or amide linkage can be formed either prior to, or subsequent to, polymerization of the unsaturated acid or ester. This can be done easily by transesterification or transamidation. The preferred materials are those containing the 3-(N,N-dimethylpropyl) moiety.

Shear stability of a polymeric viscosity modifier is determined by its molecular weight. The polymers useful in this invention can have molecular weights from about 5,000 amu's (atomic mass units) to over 1,000,000 amu's. However, polymers with the required shear stability will have molecular weights below about 175,000 amu's and preferably below 150,000 amu's.

Typically the polymeric viscosity modifiers are sold commercially as concentrates in lubricant base oils. Concentration can vary from several percent up to more than 90% polymer. Therefore the concentration of actual polymer used in the finished lubricant, exclusive of diluent oil, can range from about 0.5% to about 50%. The preferred concentration of polymer is from about 1% to 30% and most preferred is from about 2% to about 20%.

The preferred polymers are the polymethacrylate polymers with molecular weights below 175,000 amu's. These products are available commercially from the RohMax division of DeGussa and sold as Viscoplex 0–10; Viscoplex 0–50; Viscoplex 0–110; Viscoplex 0–220; Viscoplex 5089 and Viscoplex 5151.

Representative amounts of other additives in a power transmission fluid are summarized as follows:

| Additive | Broad Wt. % | Preferred Wt. % |
|---|---|---|
| Corrosion Inhibitor | 0.01–3 | 0.02–1 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Pour Point Depressants | 0.01–2 | 0.01–1.5 |
| Seal Swellants | 0.1–8 | 0.5–5 |
| Lubricating Oil | Balance | Balance |

The additive combinations of this invention may be combined with other desired lubricating oil additives to form a concentrate. Typically the active ingredient (a.i.) level of the concentrate will range from 20 to 90 wt. % of the concentrate, preferably from 25 to 80 wt. %, most preferably from 35 to 75 wt. %. The balance of the concentrate is a diluent typically comprised of a lubricating oil or solvent.

The following examples are given as specific illustrations of the claimed invention. It should be understood, however, that the invention is not limited to the specific details set forth in the examples. All parts and percentages are by weight unless otherwise specified.

EXAMPLES

No standardized test exists for evaluating anti-shudder durability of automatic transmission fluids. Several test methods have been discussed in published literature. The methods all share a common theme, i.e., continuously sliding a friction disk immersed in a test fluid at a certain set of conditions. At preset intervals, the friction versus velocity characteristics of the fluid are determined. The common failing criteria for these tests is when dMu/dV (the change in friction coefficient with velocity) becomes negative, i.e., when increasing velocity results in lower friction coefficient. A similar method which is described below, has been used to evaluate the compositions of this invention.

Example 1

Anti-shudder Durability Test Method

An SAE No. 2 test machine fitted with a standard test head was modified to allow test fluid to be circulated from an external constant temperature reservoir to the test head and back. The test head is prepared by inserting a friction disk and two steel separator plates representative of the sliding torque converter clutch (this assembly is referred to as the clutch pack). Two liters of test fluid are placed in the heated bath along with a 32 $cm^2$ (5 $in.^2$) copper coupon. A small pump circulates the test fluid from the reservoir to the test head in a loop. The fluid in the reservoir is heated to 145° C. while being circulated through the test head, and 50 ml/min. of air are supplied to the test head. The SAE No. 2 machine drive system is started and the test plate rotated at 180 rpm, with no apply pressure on the clutch pack. This break-in period is continued for one hour. At the end of one hour five (5) friction coefficient (Mu) versus velocity measurements are made. Then 6 dynamic engagements of 13,500 joules each are run, followed by one measurement of static breakaway friction. Once this data collection is accomplished, a durability cycle is begun.

The durability cycle is run in approximately one hour segments. Each hour the system is "slipped" at 155° C., 180 rpm, and 10 $kg/cm^2$ for 50 minutes. At the end of the 50 minutes of slipping, twenty (20) 13,500 joule dynamic engagements are run. This procedure is repeated three more times, giving a four hour durability cycle. At the end of four hours, 5 Mu versus velocity measurements are made at 120° C. The dMu/dV for the fluid is calculated by averaging the 3rd, 4th, and 5th Mu versus velocity measurements and calculating dMu/dV by subtracting the Mu value at 0.35 m/s from the Mu value at 1.2 m/s and dividing by the speed difference, 0.85 m/s. For convenience, the number is multiplied by 1000 to convert it to a whole number. A fluid is considered to have lost anti-shudder protection when the dMu/dV reaches a value of negative three (−3). The result is reported as "Hours to Fail". Several commercial ATF's which do not possess anti-shudder durability characteristics have been evaluated by this test method. They give "Hours to Fail" in the range of 15 to 25.

Seven test fluids were prepared using different additive combinations dissolved in a synthetic base fluid. These fluids were evaluated for anti-shudder durability using the method described above. The compositions of the seven test fluids are shown in Table 1 below.

TABLE 1

| | Test Fluid Compositions and Test Results | | | | | | |
|---|---|---|---|---|---|---|---|
| | 1 | 2 | 3 | 4 | 5 | 6 | 7 |
| Anti-Wear | | | | | | | |
| Zinc Dithiophosphate | 0.20 | 0.20 | — | — | — | — | — |
| Phosphate Ester (Vanlube 7611M) | — | — | — | 0.50 | 0.50 | 0.50 | 0.50 |
| Dibutyl Phosphite | — | — | 0.18 | — | — | — | — |
| Thioalkyl Phosphite | 0.36 | 0.36 | — | — | — | 0.20 | 0.20 |
| Metallic Detergent | | | | | | | |
| Sulfurized Alkyl Phenate | 0.50 | 0.50 | — | 0.25 | — | 0.25 | — |
| 300 TBN Calcium Sulfonate | — | — | — | — | 0.25 | — | 0.25 |
| 400 TBN Calcium Sulfonate | — | — | 0.25 | — | — | — | — |

TABLE 1-continued

| Test Fluid Compositions and Test Results | 1 | 2 | 3 | 4 | 5 | 6 | 7 |
|---|---|---|---|---|---|---|---|
| Friction Modifier* | 1.00 | 3.50 | 1.00 | 2.00 | 2.00 | 2.00 | 2.00 |
| Hour to Fail | 25 | 130 | 15 | 250 | 180 | 215 | 175 |

*The friction modifier was prepared as follows: into a one liter round bottomed flask fitted with a mechanical stirrer, nitrogen sweep, Dean Starke trap and condenser was placed 458 g (1.30 mol) of isooctadecenylsuccinic anhydride (ODSA from Dixie Chemical Co.). A slow nitrogen sweep was begun, the stirrer started and the material heated to 130° C. Commercial diethylene triamine, 61.5 g (0.6 mol), was immediately added slowly through a dip tube to the hot stirred iso-octadecenylsuccinic anhydride. The temperature of the mixture increased to 150° C. and was held there for two hours. During this heating period, 11 ml. of water were collected in the Dean Starke trap. The flask was cooled to yield the product. Yield: 505 g; percent nitrogen: 4.97.

Fluids 1 and 2 in the above table are conventionally formulated power transmission fluids using zinc dithiophosphate anti-wear systems. They show that with very elevated levels of friction modifiers, 3.5% versus 1.0% (Fluid 2 compared to Fluid 1) that some level of increased anti-shudder durability can be achieved. Replacing the zinc dithiophosphate with dibutyl hydrogen phosphite (Fluid 3) gives no improvement in anti-shudder durability (compare Fluids 3 and 1). Changing the anti-wear system to a phosphate ester of the present invention (Vanlube 7611M which is $(R—O)_2—P(:S)—S—CH(COOR_1)CH_2COOR_2$, where R, $R_1$ and $R_2$ are $C_3$–$C_8$ alkyl, as reported in U.S. Pat. No. 6,235,686 by R. T. Vanderbilt Co.) gives a dramatic improvement in the anti-shudder durability (compare Fluids 4 and 5 to Fluids 2 and 3). Even when the thioalkyl phosphite is added back into the fluids formulated with the phosphate ester, Fluids 6 and 7, their anti-shudder durability is still significantly improved versus the zinc dithiophosphate containing fluids.

Example 2

No standard method exists for the determination of steel-on-steel friction coefficient as it applies to the variator in a continuously variable transmission. However the method described below has been published and is accepted as giving results that predict variator performance.

Steel-on-Steel Friction Test

The test was conducted using a Falex Model 1 test apparatus fitted with a standard Timken test ring and a CVT belt element. The CVT belt element was loaded against the test ring with a 1500 N/mm$^2$ load, and the ring was oscillated over a 20 degree arc. The test fluid was maintained at 100° C. during the procedure. Friction coefficient was measured at the mid point of the arc, when speed was approximately 3 cm/sec, yielding a dynamic coefficient of friction and just as the speed approached zero, yielding a static coefficient of friction.

The same seven lubricants shown in Table 1 were evaluated for steel-on-steel friction characteristics in the above test method. This test gives both a static and dynamic coefficient of friction for the lubricant. The static and dynamic coefficients measured for these lubricants are shown in Table 2.

TABLE 2

| Steel-on-Steel Friction Coefficients Load = 1500 N/mm2 Temperature - 100° C. | | | | | | | |
|---|---|---|---|---|---|---|---|
| Friction Coefficient | 1 | 2 | 3 | 4 | 5 | 6 | 7 |
| Dynamic | 0.138 | 0.146 | 0.160 | 0.139 | 0.141 | 0.138 | 0.144 |
| Static | 0.159 | 0.165 | 0.181 | 0.152 | 0.162 | 0.162 | 0.169 |

The results in table 2 show that the lubricants of the current invention are well suited for use in continuously variable transmissions as they possess very high steel-on-steel friction coefficients. Fluid 3 has the highest measured coefficient of friction in this evaluation however it has unsuitable anti-shudder durability. Fluids 4 and 5 give very good steel-on-steel friction coefficients when compared to fluid 1 which is used as a CVT lubricant. Adding the thioalkyl phosphite increases the static coefficient of friction even more (compare fluid 4 to fluid 6 and fluid 5 to fluid 7).

What is claimed is:

1. A power transmission fluid composition comprising a mixture of:

(1) a major amount of a lubricating oil; and (2) an effective amount of a performance enhancing additive combination comprising:

(a) an organic phosphate having the structure: $R_1—X_2—P(:X_1)(R_2X_3)—X—R_5$ where $R_1$ and $R_2$ may independently be substituted or unsubstituted alkyl, aryl, alkylaryl or cycloallyl having 1 to 24 carbon atoms and X, $X_1$, $X_2$ and $X_3$ may independently be sulfur or oxygen; $R_1$ and $R_2$ may also contain chlorine, sulfur, oxygen or nitrogen; wherein $R_5$ is derived from a reactive olefin and can be either $—CH_2—CHR—C(:O)O—R_6$; $—CH_2—CR_7HR_8$; or $R_9—OC(:O)CH_2—CH—C(:O)O—R_{10}$ where R is H or the same as $R_1$, $R_6$, $R_7$, $R_9$ and $R_{10}$ are the same as $R_1$ and $R_8$ is a phenyl or alkyl or allenyl substituted phenyl moiety, the moiety having from 6 to 30 carbon atoms;

(b) a calcium detergent; and (c) a friction modifier.

2. The composition of claim 1 further comprising an organic phosphite of the formula:

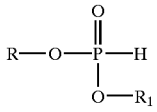

wherein R is hydrocarbyl and R1 is hydrocarbyl or hydrogen.

3. The composition of claim 1 further comprising a shear stable viscosity modifier.

4. The composition of claim 1, 2 or 3 wherein the organic phosphate contains sulfur.

5. The composition of claim 1, 2 or 3 further comprising an ashless dispersant.

6. The composition of claim 1 wherein the organic phosphate has the formula $(R—O)_2—P(:S)—S—CH(COOR_1)CH_2COOR_2$, where R, $R_1$ and $R_2$ are $C_3$–$C_8$ alkyl.

7. The composition of claim 1, 2 or 3 wherein the friction modifier is a succinimide of the structure

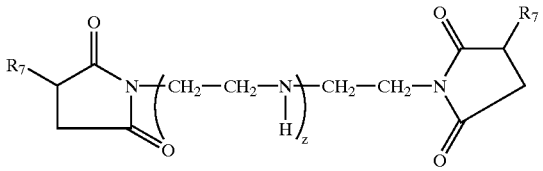

wherein $R_7$ is $C_6$ to $C_{30}$ alkyl, and z=1 to 10.

8. The composition of claim 1, 2 or 3 wherein the friction modifier is an ethoxylated amine having the structure

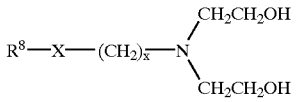

wherein $R_8$ is a $C_6$ to $C_{28}$ alkyl group, X is O, S or $CH_2$, and x=1 to 6 or the reaction product of an ethoxylated amine with a boron compound, the reaction product having the structure:

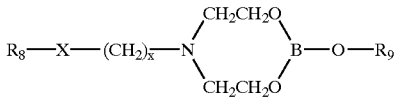

where $R_8$ is a $C_6$ to $C_{28}$alkyl group, $R_9$ is either hydrogen or an alkyl radical, X is O, S or $CH_2$, and x=1 to 6.

9. The composition of claim 1, 2 or 3 wherein the friction modifier is a primary amide of the structure $RCONH_2$ wherein R is an alkyl or alkenyl group having about 12 to 24 carbons.

10. The composition of claim 9, wherein said primary amide is oleamide.

11. A CVT apparatus containing the fluid of claim 1, 2 or 3.

12. A performance enhancing additive composition comprising:

(a) an organic phosphate having the structure: $R_1—X_2—P(:X_1)(R_2X_3)—X—R_5$ where $R_1$ and $R_2$ may independently be substituted or unsubstituted alkyl, aryl, alkylaryl or cycloallyl having 1 to 24 carbon atoms and X, $X_1$, $X_2$ and $X_3$ may independently be sulfur or oxygen; $R_1$ and $R_2$ may also contain chlorine, sulfur, oxygen or nitrogen; wherein $R_5$ is derived from a reactive olefin and can be either $—CH_2—CHR—C(:O)O—R_6$; $—CH_2—CR_7HR_8$; or $R_9—OC(:O)CH_2—CH—C(:O)O—R_{10}$ where R is H or the same as $R_1$, $R_6$, $R_7$, $R_9$ and $R_{10}$ are the same as $R_1$ and $R_8$ is a phenyl or alkyl or allenyl substituted phenyl moiety, the moiety having from 6 to 30 carbon atoms;

(b) a calcium detergent; and (c) a friction modifier.

13. The composition of claim 1 further comprising an organic phosphite of the formula:

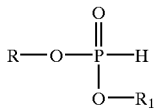

wherein R is hydrocarbyl and R1 is hydrocarbyl or hydrogen.

14. The composition of claim 1 further comprising a shear stable viscosity modifier.

15. The composition of claim 12, 13 or 14 wherein the organic phosphate contains sulfur.

16. The composition of claim 12, 13 or 14 further comprising an ashless dispersant.

17. The composition of claim 12, 13 or 14 wherein the organic phosphate has the formula $(R—O)_2—P(:S)—S—CH(COOR_1)CH_2COOR_2$, where R, $R_1$ and $R_2$ are $C_3$–$C_8$ alkyl.

18. The composition of claim 12, 13 or 14 wherein the friction modifier is a succinimide of the structure

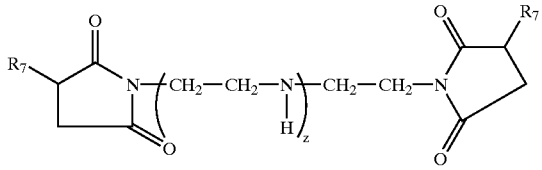

wherein $R_7$ is $C_6$ to $C_{30}$ alkyl, and z=1 to 10.

19. The composition of claim 12, 13 or 14 wherein the friction modifier is an ethoxylated amine having the structure

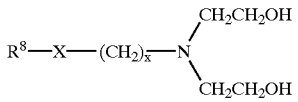

wherein $R_8$ is a $C_6$ to $C_{28}$ alkyl group, X is O, S or $CH_2$, and x=1 to 6 or the reaction product of an ethoxylated amine with a boron compound, the reaction product having the structure:

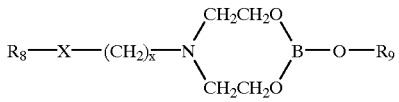

where $R_8$ is a $C_6$ to $C_{28}$ alkyl group, $R_9$ is either hydrogen or an alkyl radical X is O, S or $CH_2$, and x=1 to 6.

20. The composition of claim 12, 13 or 14 wherein the friction modifier is a primary amide of the structure $$RCONH_2$$

wherein R is an alkyl or alkenyl group having about 12 to 24 carbons.

21. The composition of claim 20, wherein said primary amide is oleamide.

22. An additive concentrate comprising diluent oil and 20 to 90 wt. % of the additive composition of claims 12, 13 or 14.

* * * * *

UNITED STATES PATENT AND TRADEMARK OFFICE

CERTIFICATE OF CORRECTION

PATENT NO. : 6,660,695 B2
DATED : December 9, 2003
INVENTOR(S) : R.F. Watts et al.

It is certified that error appears in the above-identified patent and that said Letters Patent is hereby corrected as shown below:

Column 18,
Line 54, change “cycloallyl” to -- cycloalkyl -- and in
Line 63, change “allenyl” to -- alkenyl --.

Column 20,
Line 2, change “cycloallyl” to -- cycloalkyl -- and in
Line 10, change “allenyl” to -- alkenyl --.

Signed and Sealed this

Third Day of February, 2004

JON W. DUDAS
*Acting Director of the United States Patent and Trademark Office*